US005471857A

United States Patent [19]

Dickerson

[11] Patent Number: 5,471,857

[45] Date of Patent: Dec. 5, 1995

[54] PROCESS FOR HYDROFORMING A VEHICLE MANIFOLD

[75] Inventor: Devere C. Dickerson, Hamburg, Mich.

[73] Assignee: MascoTech Tubular Products, Inc., Hamburg, Mich.

[21] Appl. No.: 207,570

[22] Filed: Mar. 7, 1994

[51] Int. Cl.[6] ..... B21D 9/15; B21D 15/03; B21D 26/02

[52] U.S. Cl. ..... 72/57; 72/58; 29/890.08

[58] Field of Search ..... 72/57, 58, 59, 72/60, 61, 62, 370; 29/421.1, 890.8

[56] References Cited

U.S. PATENT DOCUMENTS

| | | | |
|---|---|---|---|
| 2,182,958 | 12/1939 | Bullock . | |
| 3,240,048 | 3/1966 | Callendar . | |
| 3,245,433 | 4/1966 | Taylor, Jr. . | |
| 3,388,573 | 6/1968 | Presley, Jr. . | |
| 3,650,140 | 3/1972 | Zmuda . | |
| 4,061,005 | 12/1977 | Kawanami et al. . | |
| 4,135,380 | 1/1989 | Olszewski et al. . | |
| 4,319,471 | 3/1982 | Benteler et al. | 72/59 |
| 4,555,924 | 12/1985 | Remy et al. . | |
| 4,567,743 | 2/1986 | Cudini | 72/61 |
| 4,827,747 | 5/1989 | Okada et al. | 72/59 |
| 5,010,758 | 4/1991 | Togoshi . | |
| 5,113,683 | 5/1992 | Lafrasse . | |
| 5,239,852 | 8/1993 | Roper . | |
| 5,353,618 | 10/1994 | Roper et al. | 72/57 |

*Primary Examiner*—David Jones
*Attorney, Agent, or Firm*—Edgar A. Zarins; Malcolm L. Sutherland

[57] ABSTRACT

A hydroforming process and apparatus for manufacturing components of a vehicle exhaust or intake manifold. The hydroforming process is utilized to form a tubular member to the desired configuration for use in a manifold. The tubular member is loaded into a hydroform press and filled with a suitable liquid. The liquid within the tube is pressurized in order to maintain a predetermined internal fluid pressure which prevents collapse and crimping of the tube during forming. The hydroform press includes two sets of dies to form a compound bend in the pressurized tube. Upper and lower dies close on the tube first to bend the tube in a vertical plane. Horizontal dies are wedged inwardly spreading the first die set and bending the tube in a horizontal plane. As a result, a compound configuration may be placed on the tube making it suitable for use in a vehicle manifold.

15 Claims, 3 Drawing Sheets

PROCESS FOR HYDROFORMING A VEHICLE MANIFOLD

BACKGROUND OF THE INVENTION

I. Field of the Invention

This invention relates to a process for forming the tubular members of a vehicle manifold and, in particular, to forming the compound curvatures of the tubular member using cooperating die sets and a hydroforming process to maintain an internal fluid pressure preventing deformation of the tube during bending.

II. Description of the Prior Art

Various metal forming processes are known for creating complex configurations from a metal blank. Sheet metal may be stamped and stretched to form the desired configuration. Tubular blanks have been bent, stretched and radially expanded to form complex configurations. However, depending upon the size of the tubing and the complexity of the desired configuration, crimping or buckling may occur at the inner radius of the bend. In past situations, the inner radius has been supported to guide the compression at the inner surface as the outer surface is stretched. Nevertheless, even with support certain configurations simply cannot be formed without deformation of the tubular member.

Hydroforming of metal components was developed to alleviate the deformation of the metal during bending, stretching, etc. into complex configurations. The general principal of hydroforming comprises applying a predetermined fluid pressure to an area of the metal to be manipulated. In the case of a tubular member, an internal fluid pressure is applied as the tube is bent and stretched. Typically, this is accomplished by immersing the tube in a fluid bath to fill the tube, applying end plugs to the tube which are used to increase the internal pressure to a predetermined level and bending the tube along a plane perpendicular to the die stroke. Under certain procedures, the tube may be bent around a die to the desired configuration. The hydroforming process may also be used to radially expand sections of the tube by increasing the internal pressure at that region.

Despite the advantages a hydroforming process provides in manipulating metal without deformation, the complexity of the bent tube is limited by the dies used in the process. The known hydroforming processes bend the tube only in a single plane. Modern components are becoming increasingly complicated requiring compound bends. The hydroforming process lends itself to the formation of complex tubular products without deformation of the metal material.

SUMMARY OF THE PRESENT INVENTION

The present invention overcomes the disadvantages of the prior known methods of forming complex tubular members by providing a hydroforming process which prevents deformation of the tube in conjunction with a pair of die sets to form the complex configuration.

The present invention is directed to a hydroforming process to form compound bends in a tubular member to be used in a vehicle manifold. With increased space constrictions, vehicle manufacturers are designing engines which include manifold pipes bending through closely defined spaces. Add to this the pressure to manufacture such components in a cost effective manner while maintaining the highest standards of quality. The process and apparatus of the present invention facilitates the attainment of these objections.

The hydroforming process of the present invention involves delivering a tubular blank to a fluid bath which fills the blank with a hydroforming fluid. The ends of the blank are plugged and the internal fluid pressure is increased to the desired level. The dies of a dual direction die press are sequentially brought into engagement with the pressurized tubular blank to first bend the tube along one plane and then another. A first set of upper and lower dies close around the blank to bend the tube in the vertical plane. A second set of horizontal dies are wedged between the upper and lower dies to spread them as the horizontal dies bend the tube in the horizontal plane. The vertical bends formed by the first die set will be formed in the horizontal dies so that the vertical bends are not deformed as the horizontal die set forms the second bend. With the configuration of the tubular member formed, the part can be released from the apparatus for final trimming and parting.

Other objects, features, and advantages of the invention will be apparent from the following detailed description taken in connection with the accompanying drawings.

BRIEF DESCRIPTION OF THE DRAWINGS

The present invent ion will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
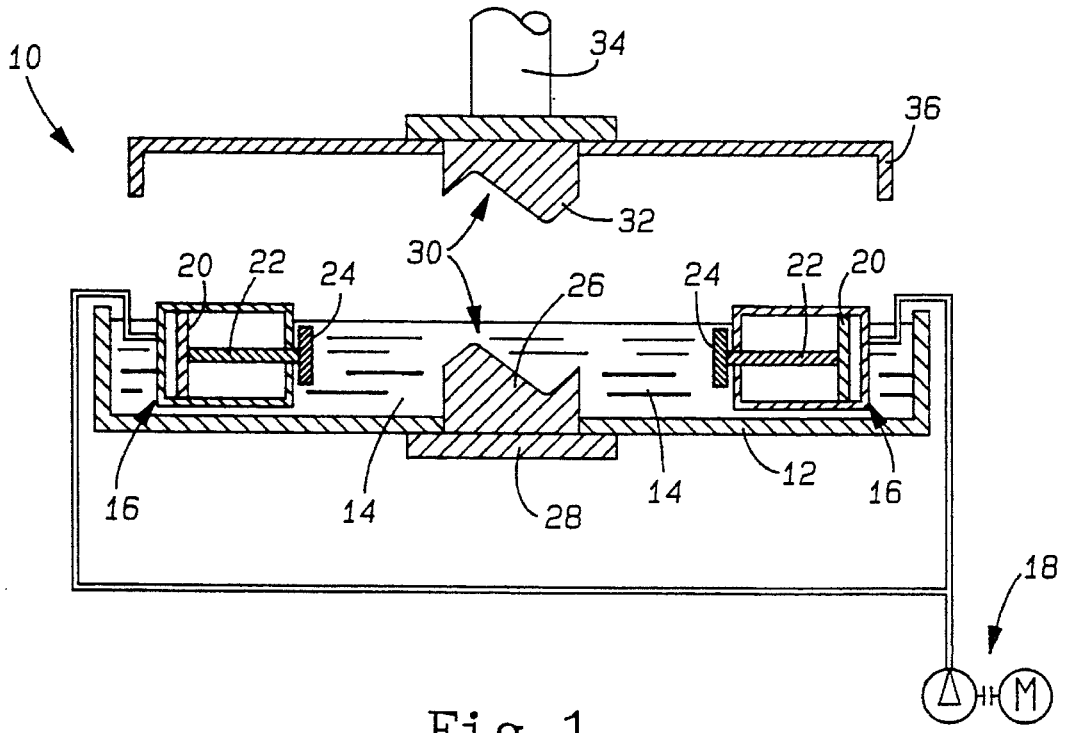
FIG. 1 is a cross-sectional view of a hydroforming apparatus for manufacturing a tubular member for a vehicle manifold having a compound configuration.

Referring first to FIGS. 1 through 5, there is shown an apparatus 10 for the manufacture of complex tubular members in accordance with the present invention. The tubular members of the present invention are adapted for use as the exhaust or intake pipes of a vehicle manifold and include compound curvatures including "bend-on-bend" which can only be economically accomplished using the technology of the present invention. The bend-on-bend compound curvature of the tubular member can best be defined as an end of the tube in a first plane with an overlying bend in a second, typically perpendicular, plane. The hydroforming apparatus and process of the present invention reliably accomplishes the compound curvature necessary to form a vehicle manifold tube capable of fitting within modern engine compartments.

The hydroforming apparatus 10 of the present invention includes a bath or pan 12 forming a reservoir for the hydroforming fluid 14. A pair of hydraulic cylinders 16 are disposed within the pan 12. The cylinders 16 are in fluid communication with a hydraulic power unit 18 which controls the reciprocal movement of a piston 20 within the cylinder 16. The piston 20 is connected to a rod 22 which extends from the cylinder housing 16 and has a plug 24 mounted to the exterior end of the piston rod 22. The plugs 24 of the hydraulic cylinders 16 are used to seal the ends of the tubular blank 100 to create an internal fluid pressure during the hydroforming process as will be subsequently described.

Positioned within the pan 12 is a stationary lower die 26. The lower die 26 is supported by a bolster 28 beneath the pan 12 in order to withstand the stamping forces associated with the process. The lower die 26 forms a part of a first die set 30 which also includes upper die 32 movable into mating engagement with lower die 26. The first die set 30 forms the bends of the tubular member 100 along a first vertical plane. The upper die 32 is secured to a slide 34 which is used to move the upper die 32 vertically into stamping engagement. A splash shield 36 is provided on the upper die 32 to minimize the splash of fluid from the pan 12 during the stamping process.

Figure 6:
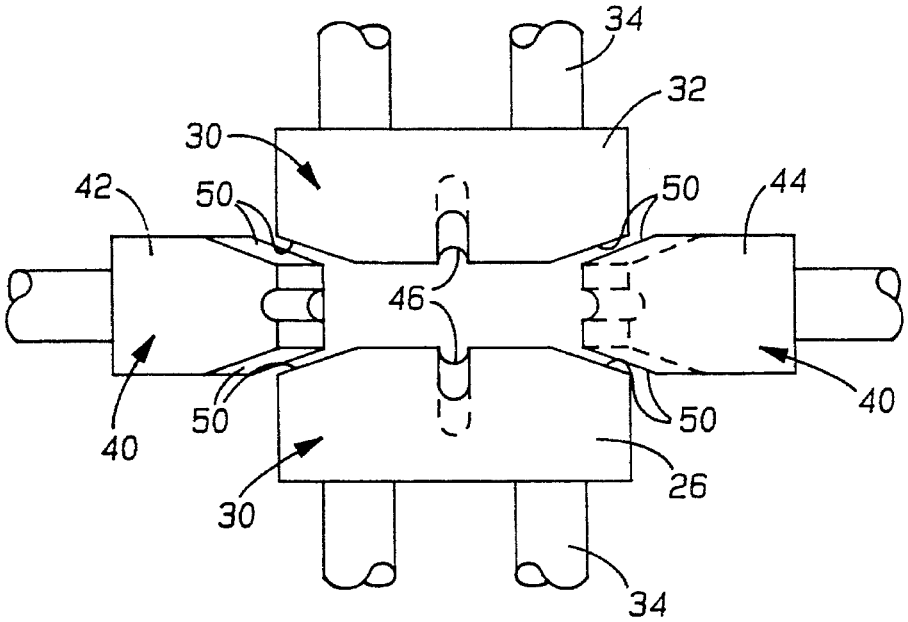
FIG. 6 is an end perspective of the die for forming the tubular member along the two bend planes.

Referring now to FIG. 6, while the first die set 30 is suitable for forming a first set of bends in the tubular member 100, a second die set 40 is used to form bends along a second, typically perpendicular plane. The second die set 40 includes a first horizontal die 42 and a second horizontal die 44 which engage the tubular blank 100 from the sides. The upper and lower die set 30 includes a tooling configuration 46 which imparts a desired configuration on the tubular member 100. This tooling configuration 46 is disposed in a first, vertical plane which imparts bends along a first plane. Consequently, the second die set 40 must incorporate the bends along the vertical plane in order to receive the tubular member 100 along the second horizontal plane. As a result, the tubular member 100 will have a compound curvature including bend-on-bend configuration imposed by the sequential stamping of the die sets 30 and 40.

The die sets 30,40 each include cooperating camming surfaces 50 along a corner edge. The surfaces 50 are used to wedge the second die set 40 between the first die set 30. With the first die set 30 closed on the tubular member 100, the second die set 40 is extended between the cam surfaces 50 of the first die set 30 to spread the first die set 30 and permit the second die set 40 to stamp the tubular member 100 along the second plane.

Referring to FIGS. 1 through 6, the process of manufacturing a compound tubular member using hydroforming will now be described. It should be understood that both die sets 30 and 40 are utilized in the apparatus 10 in order to form the compound curvature. Additionally, a hydroforming process is used whereby a predetermined fluid pressure is maintained within the tubular member to prevent deformation during the dual stamping process. Without the internal pressure, the bend-on-bend compound curvature could not be reliably constructed.

Figure 2:
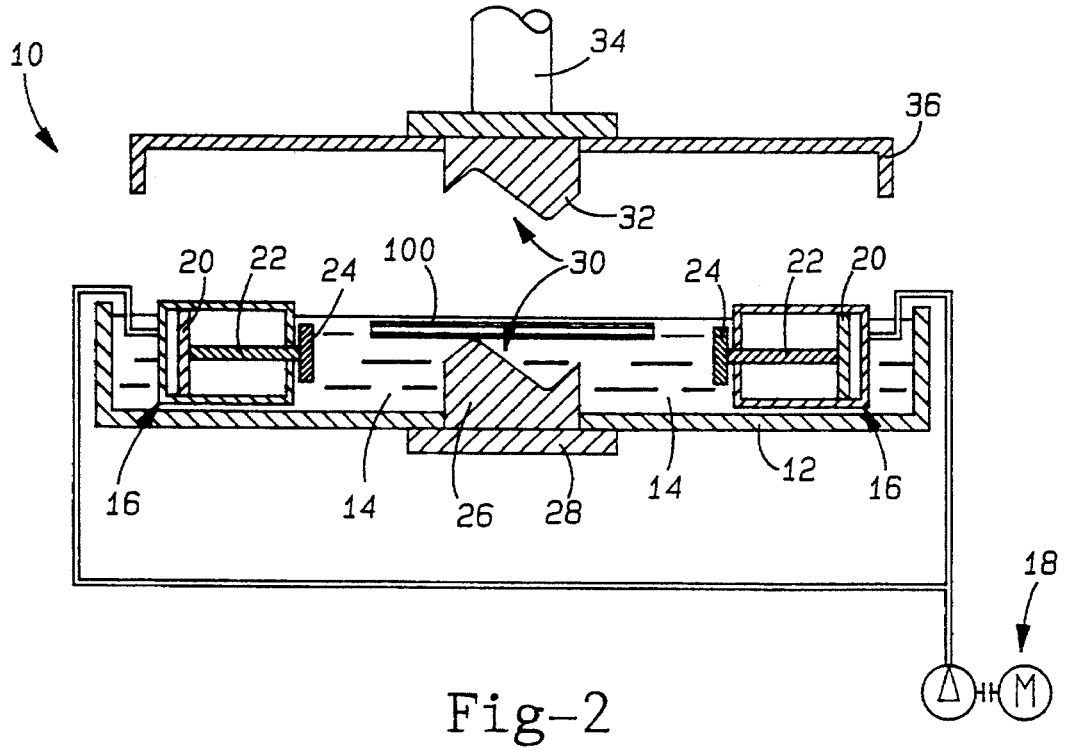
FIG. 2 is a cross-sectional view of the apparatus with a tubular blank delivered to the apparatus.
Figure 3:
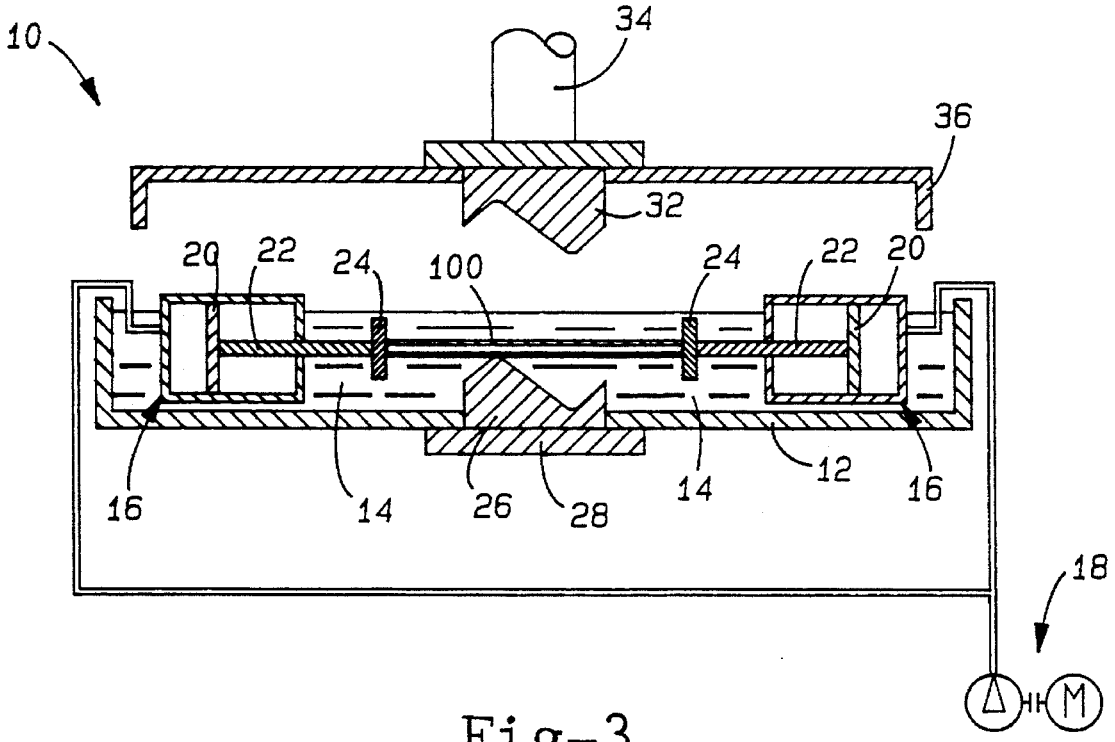
FIG. 3 is a cross-sectional view of the apparatus with the ends of the tubular blank plugged for increased internal fluid pressure.
Figure 4:
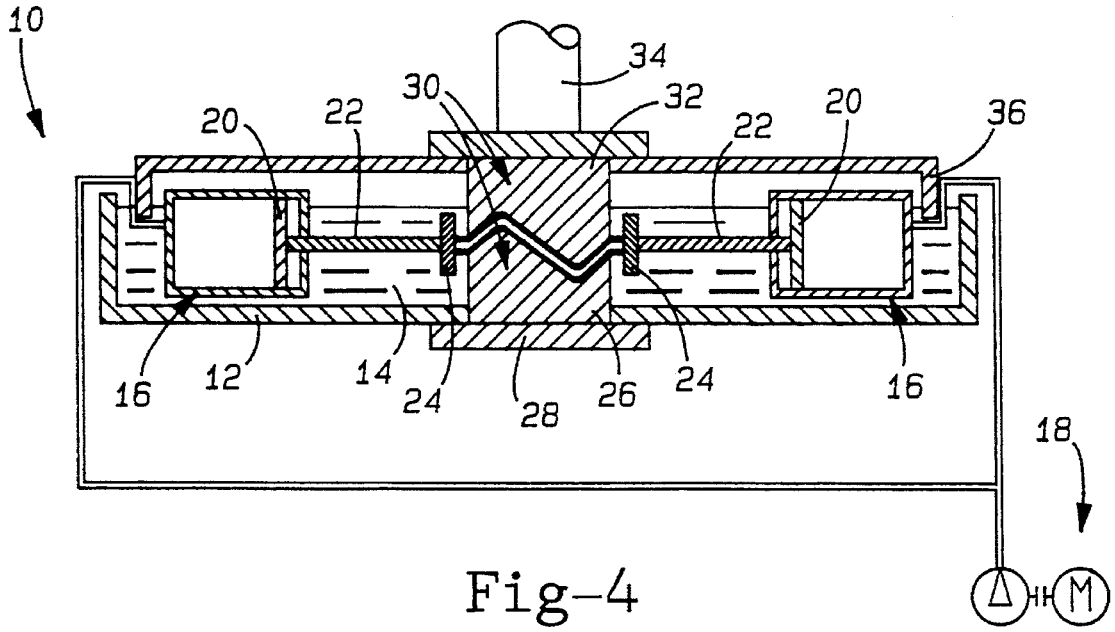
FIG. 4 is a cross-sectional view of the apparatus with the first die set in contact with the tubular blank to bend the tube along first plane.
Figure 5:
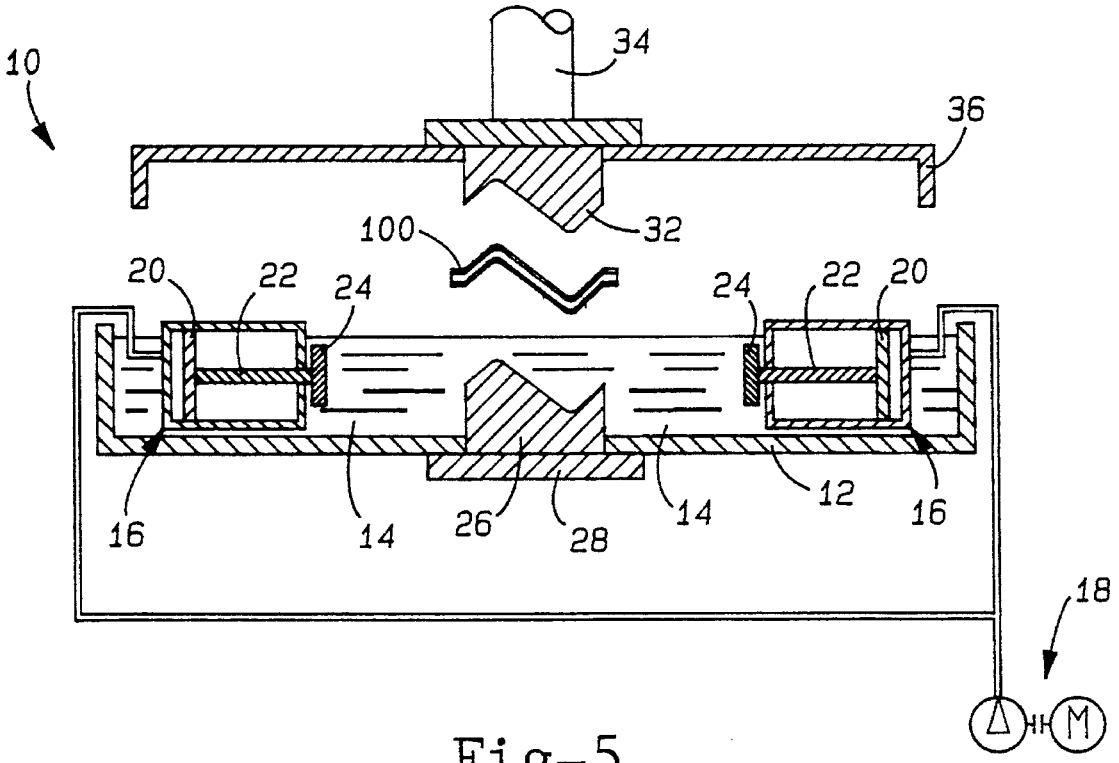
FIG. 5 is a cross-sectional view of the apparatus with the finished tube removed from the apparatus.

FIG. 1 shows the apparatus 10 in a stand-by position with the die sets 30,40 and the hydraulic cylinders 16 retracted. A tubular blank 100 is delivered to the pan 12 and immersed within the fluid 14 (FIG. 2). Although the fluid 14 may be any number of different fluids, preferably the fluid 14 is a hydraulic oil which will prevent corrosion of the part yet is compressible within the tubular member 100 to create the desired internal pressure. As shown in FIG. 3, the plugs 24 are extended to engage the ends of the tubular member 100. The fluid pressure within the tube 100 is increased to the desired level to prevent deformation during the stamping operation. With the tubular member 100 secured and pressurized (FIG. 4), first the upper and lower die set 30 engages the tubular blank 100 to impart bends along a vertical plane and then the second die set 40 stamps the second bends on the tubular blank 100. Upon completion of the stamping operations, the die sets 30,40 are fully retracted and the plugs 24 withdrawn to release the manifold tube 100. Subsequent trimming and cutting operations are performed at a separate station to ready the tubes 100 for incorporation into the manifold assembly. As a result, a manifold tube is manufactured in a reliable and economical manner which permits the incorporation of complex and compound curvatures to meet engineering specifications.

The foregoing detailed description has been given for clearness of understanding only and no unnecessary limitations should be understood therefrom as some modifications will be obvious to those skilled in the art without departing from the scope and spirit of the appended claims.

What is claimed is:

1. A process of manufacturing a tubular member for a vehicle manifold, said tubular member having a compound curvature suitable for use in the vehicle manifold, said process comprising the steps of:

delivering a tubular blank to an apparatus having a fluid bath, plug means for retaining ends of said tubular blank and a plurality of die tools for stamping the compound curvature into said tubular blank;

positioning said tubular blank within said fluid bath to fill said blank with a fluid;

extending said plug means into retaining engagement with the ends of said tubular blank sealing said tubular blank;

increasing the internal fluid pressure within said tubular blank to a predetermined level to pressurize the interior of said blank;

stamping said compound curvature into said tubular blank by bringing said die tools into engagement with the blank, said compound curvature including bends in at least two planes suitable for use as a tubular member of a vehicle manifold; and transferring said tubular member from said apparatus for incorporation into the vehicle manifold.

2. The process as defined in claim 1 wherein said stamping step includes sequentially actuating two separate sets of die tools, a first set of die tools bending said tubular blank in a first plane and a second set of die tools ending said tubular blank in a second plane.

3. The process as defined in claim 2 wherein said second set of die tools incorporate the configuration of said tubular blank in said first plane to facilitate reception of said tubular blank into said second set of die tools.

4. The process as defined in claim 3 wherein said first set of die tools are vertically oriented to incorporate bends into the tubular blank along a vertical plane.

5. The process as defined in claim 4 wherein said second set of die tools are horizontally oriented to incorporate bends into the tubular blank along a horizontal plane, said bends along said horizontal plane being formed on said bends along said vertical plane.

6. The process as defined in claim 2 wherein said plug means for retaining and sealing the ends of said tubular blank includes a pair of hydraulically-actuated cylinders having a piston rod selectively extendable to engage a plug with the end of said tubular blank, said plug sealing the end of the tubular blank.

7. The process as defined in claim 6 wherein said tubular blank is pressurized through said plug means to create a hydroforming internal fluid pressure within said tubular blank to prevent deformation during stamping.

8. The process as defined in claim 1 and comprising the further step of mounting a plurality of stamped tubular members to a manifold housing to form said vehicle manifold.

9. A process of manufacturing a manifold for an engine of a vehicle, said manifold including a housing and a plurality of tubular members having a compound curvature, said process comprising the steps of:

delivering a tubular blank to an apparatus having a fluid bath, plug means for retaining ends of said tubular blank and a plurality of die tools for stamping the compound curvature into said tubular blank;

positioning said tubular blank within said fluid bath to fill said blank with a fluid;

extending said plug means into retaining engagement with the ends of said tubular blank to seal said tubular blank;

increasing the internal fluid pressure within said tubular blank to a predetermined level to pressurize the interior of said blank;

stamping said compound curvature into said tubular blank by bringing said die tools into engagement with the blank, said compound curvature including bends in at least two planes;

transferring said tubular member from said apparatus from trimming of said tubular member; and attachment of a plurality of said tubular members to the manifold housing to form said vehicle manifold.

10. The process as defined in claim 9 wherein said stamping step includes sequentially actuating two separate sets of die tools, a first set of die tools bending said tubular blank in a first plane and a second set of die tools bending said tubular blank in a second plane.

11. The process as defined in claim 10 wherein said second set of die tools incorporate the configuration of said tubular blank in said first plane to facilitate reception of said tubular blank into said second set of die tools.

12. The process as defined in claim 11 wherein said first set of die tools are vertically oriented to incorporate bends into the tubular blank along a vertical plane.

13. The process as defined in claim 12 wherein said second set of die tools are horizontally oriented to incorporate bends into the tubular blank along a horizontal plane, said bends along said horizontal plane being formed on said bends along said vertical plane.

14. The process as defined in claim 10 wherein said plug means for retaining and sealing the ends of said tubular blank includes a pair of hydraulically-actuated cylinders having a piston rod selectively extendable to engage a plug with the end of said tubular blank, said plug sealing the end of the tubular blank.

15. The process as defined in claim 14 wherein said tubular blank is pressurized through said plug means to create a hydroforming interval fluid pressure within said tubular blank to prevent deformation during stamping.

* * * * *